US006256789B1

(12) United States Patent
Young et al.

(10) Patent No.: US 6,256,789 B1
(45) Date of Patent: Jul. 10, 2001

(54) COMBINATION GARMENT AND SAFETY HARNESS

(76) Inventors: David A. Young, 27689 Joyce Dr.; Jonnathan Mark Townsend, 10217 DuPont Rd., both of Columbia Station, OH (US) 44028

( * ) Notice: Subject to any disclaimer, the term of this patent is extended or adjusted under 35 U.S.C. 154(b) by 0 days.

(21) Appl. No.: 09/631,431

(22) Filed: Aug. 3, 2000

Related U.S. Application Data

(63) Continuation-in-part of application No. 09/560,239, filed on Apr. 27, 2000, which is a continuation-in-part of application No. 09/295,449, filed on Apr. 21, 1999.

(51) Int. Cl.[7] ..... A41D 13/00; A62B 35/00

(52) U.S. Cl. ..... 2/69; 2/456; 182/3; 244/151 R

(58) Field of Search ..... 2/69, 79, 102, 2/94, 456, 44, 45, 108, 227, 69.5, 338; 182/3–6; 244/151 R

(56) References Cited

U.S. PATENT DOCUMENTS

| | | |
|---|---|---|
| 2,709,667 | 5/1955 | Grubb et al. . |
| 2,979,153 | 4/1961 | Hoagland et al. . |
| 3,424,134 | 1/1969 | Rosenblum . |
| 3,701,395 | 10/1972 | Theobald . |
| 4,076,101 | 2/1978 | Himmelrich . |
| 4,177,877 | 12/1979 | Gallinati . |
| 4,273,215 | 6/1981 | Leggett . |
| 4,273,216 | 6/1981 | Weissmann . |
| 4,302,847 | 12/1981 | Miles . |
| 4,625,335 | 12/1986 | Vinai . |
| 4,731,882 | 3/1988 | Ekman . |
| 4,745,870 | 5/1988 | Roth . |
| 4,854,418 | 8/1989 | Hengstenberger et al. . |
| 5,036,548 | 8/1991 | Grilliot et al. . |
| 5,136,724 | 8/1992 | Grilliot et al. . |
| 5,220,976 | 6/1993 | Gunter . |
| 5,360,082 | 11/1994 | Bell . |
| 5,738,046 | 4/1998 | Williams et al. . |
| 5,960,480 | 10/1999 | Neustater et al. . |
| 5,970,517 | 10/1999 | Jordan . |
| 6,035,440 | 3/2000 | Woodyard . |
| 6,128,782 | * 10/2000 | Young et al. ..... 2/69 |

FOREIGN PATENT DOCUMENTS

| | | |
|---|---|---|
| 218467 | 7/1924 | (GB) . |
| 1233761 | 5/1971 | (GB) . |

* cited by examiner

*Primary Examiner*—John J. Calvert
*Assistant Examiner*—Tejash Patel
(74) *Attorney, Agent, or Firm*—Richard C. Litman

(57) ABSTRACT

A combination clothing/safety harness for fall arresting and rescue from confined spaces provides the advantages of ease of use, distribution of forces over a wide surface area, protection of the harness portion, and ease of enforcing regulations that the harness be worn. The safety harness may be attached to various articles of clothing, such as a jacket, vest, overalls, or coveralls, so that donning the article of clothing automatically positions the harness for use. The harness may be used by employees working at dangerous heights or in confined spaces, or by hunters using tree stands. Combination clothing/safety harness systems can be made to meet OSHA requirements.

10 Claims, 8 Drawing Sheets

COMBINATION GARMENT AND SAFETY HARNESS

CROSS REFERENCE TO RELATED APPLICATIONS

This application is a continuation-in-part of U.S. application Ser. No. 09/560,239 filed Apr. 27, 2000, which is a continuation-in-part of U.S. application Ser. No. 09/295,449, filed Apr. 21, 1999.

BACKGROUND OF THE INVENTION

1. Field of the Invention

The present invention relates to safety garments and fall arresting harnesses. Specifically, the invention is an article of clothing having an attached harness for connection to a safety line.

2. Description of the Related Art

The need for protection from falls has long been felt by employees in dangerous professions, such as construction work, utility repairmen, and many others who must work at dangerous heights. The minimum requirements for such protection are described in 29 C.F.R. § 1926.502. The need has also been felt by hunters, who frequently wait for game sitting in elevated tree stands. Additionally, workers entering confined spaces face certain risks, such as lack of oxygen, or being injured while in a location with limited access for rescuers. The Occupational Health and Safety Administration also requires some entrants into confined spaces to wear body harnesses for attachment to a retrieval line, (U.S. Department of Labor, Occupational Health and Safety Administration, Permit-Required Confined Spaces 11 (1998)).

Given the importance of such safety precautions, it is no surprise that several other inventors have proposed various body harnesses for fall arresting. However, no other safety harness within the knowledge of the present invention combines all of the advantages of ease of use, distribution of forces over the widest possible surface area, protection of the harness itself by the clothing, and ease of enforcement of rules requiring use of the harness.

An example of protective clothing unrelated to fall arresting systems is U.S. Pat. No. 2,709,667, issued May 31, 1955 to Grubb et al., describing a fire fighter suit. The suit includes a helmet, jacket, and overalls made from fiberglass fabric. The overalls include a harness having a chest strap and a crotch strap, with a lift ring in back for attachment of a rescue line.

U.S. Pat. No. 2,979,153, issued Apr. 11, 1961 to Earl J. Hoagland et al., describes a safety suit. The safety suit includes a coverall garment having a harness system. The harness system includes a noose passing around each arm and leg, connecting at the back of the neck to a ring for connecting to a rescue line.

U.S. Pat. No. 4,076,101, issued Feb. 28, 1978 to Lew Himmelrich, describes a coat having a harness. The harness passes around the wearer's waist and crotch, and connects to a descent control device in front.

U.S. Pat. No. 4,273,216, issued Jun. 16, 1981 to Weissmann, describes a jacket having an outer harness with shoulder and waist straps for anchoring the user in case he loses his footing. The straps are sewn to the jacket and to corresponding straps inside the jacket.

U.S. Pat. No. 4,302,847, issued Dec. 1, 1981 to Miles, describes a jacket and pants having foam inserts protecting the lower back and hips.

U.S. Pat. No. 4,731,882, issued Mar. 22, 1988 to Ekman, describes a waistcoat or coverall including channels for a harness. The harness includes a belt, a pair of shoulder straps passing diagonally across the back and vertically across the front, attaching to the belt, and possibly a pair of crotch straps. The garment includes a D-ring in back for connecting to a safety line.

U.S. Pat. No. 4,745,870, issued May 24, 1988 to Roth, describes a windsurfing harness. The harness passes across the back of the arms and shoulders, and has a hook or glove at either end for holding the windsurfer to the sailboard boom.

U.S. Pat. No. 5,036,548, issued Aug. 6, 1991 to Grilliot et al., describes a firefighter's combination trousers and safety harness. The safety harness includes a belt and a loop extending around each leg. A loop and ring extends upward from the front of the trousers for connection to a safety line. A similar invention is described in U.S. Pat. No. 5,136,724, also issued to William L. Grilliot and Mary L. Grilliot on Aug. 11, 1992.

U.S. Pat. No. 5,738,046, issued Apr. 14, 1998 to Williams et al., describes a safety jacket and harness system. The harness includes a pair of torso straps, a pair of shoulder straps, and a central back strap having a ring for connection with a safety line. The jacket includes a plurality of flaps for snapping around the harness.

Great Britain Patent Document No. 218,467, published on Jul. 10, 1924, describes a harness for raising or lowering a person. The harness is made from rope fastened with brass rings. It has three loops: one fitting around the torso, and one for each leg.

Great Britain Patent Document No. 1,233,761, published on May 26, 1971, describes a safety harness including front and back buoyant material.

Other safety harnesses are available in the prior art, but none of them teach a harness integrally secured to the interior of a garment. For example, U.S. Pat. No. 3,424,134, issued Jan. 28, 1969 to Rosenblum, discloses an industrial harness having a panel for stabilizing the harness straps to the user. U.S. Pat. No. 3,701,395, issued Oct. 31, 1972 to Theobald, discloses a rescue and safety vest that is quickly and easily placed on an injured person in order to safely lift the person from a hazardous situation. U.S. Pat. No. 4,177,877, issued Dec. 11, 1979 to Gallinati, discloses a safety vest having tether attachments located at the shoulders. U.S. Pat. No. 4,273,215, issued Jun. 16, 1981 to Leggett, discloses safety harness for hunters having a rear gang connector for evenly distributing any tension in the supporting lifeline. U.S. Pat. No. 4,623,335, issued Dec. 2, 1986 to Vinai, discloses rescue and securing harness having a suspension point that allows the suspended person to be in correct vertical alignment. The suspension point has a fastener to facilitate the suspension point against the back of the wearer. U.S. Pat. No. 4,854,418, issued Aug. 8, 1989 to Hengstenberger et al., discloses a safety harness formed of a unitary continuous loop of material being stitched into a larger torso loop and a smaller handle loop. U.S. Pat. No. 5,220,976, issued Jun. 22, 1993 to Gunter, discloses safety harness for use in a radioactive or chemically hostile environment. U.S. Pat. No. 5,360,082, issued Nov. 11, 1994 to Bell, discloses a safety harness having a means for lowering the person safely after a fall. U.S. Pat. No. 5,960,480, issued Oct. 5, 1999 to Neustater et al., discloses a fall protection suit having channels for inserting the straps of the harness. U.S. Pat. No. 5,970,517, issued Oct. 26, 1999 to Jordan, discloses a safety harness having an integral safety line.

U.S. Pat. No. 6,035,440, issued Mar. 14, 2000 to Woodyard, discloses a combination vest and safety harness, wherein the safety harness is sewn in the vest between the outer shell and the inner lining. The plurality of buckles of the harness must be subsequently fastened after donning the vest in order to be protected from a fall while wearing the vest. The harness also includes a dorsal ring for connecting a lanyard to the harness, the dorsal ring provides additional holes for passing the shoulders through.

None of the above safety systems offers the advantages of ease of use, wide distribution of forces, protection of the safety harness, and ease of enforcement offered by the present invention. None of the above inventions and patents, taken either singularly or in combination, is seen to describe the instant invention as claimed. Thus a combination clothing/safety harness for fall arresting and rescue from confined spaces solving the aforementioned problems is desired.

SUMMARY OF THE INVENTION

The invention is a combination article of clothing and safety harness intended for fall arresting and for rescue from confined spaces. Such a harness is useful for both working at dangerous heights and in confined spaces, and for hunting from a tree stand The article of clothing combined with the harness may be varied and selected as needed, with preferred and suggested articles of clothing being jackets, vests, overalls, and coveralls. Such garments provide ample fabric for sewing in a harness extending around the shoulders, waist, and crotch, thereby maximizing the surface area acted upon by the harness.

If a jacket or vest is used, the harness will have straps extending around the arms, waist, and crotch, connected by straps extending across the back. A pair of back straps will extend diagonally down the back, meeting in the center of the back between the shoulder blades. A D-ring attachment strap will extend upward from the juncture of the back straps, extending past the collar and protruding outside the jacket for connection with a safety line. The bottom of the back straps join a belt. Horizontal arm straps extend outward from the back straps, encircling each arm. A pair of crotch straps extend downward from the belt. Additional D-rings may be located at belt level. By donning the jacket or vest, buckling the crotch straps around each leg, and buckling the belt, the wearer has properly put on the harness.

If the clothing is a pair of overalls, the suspenders of the overalls form part of the harness. Each suspender crosses diagonally across the front and back of the torso, and then wraps around the opposite leg. A D-ring attachment strap extends from the rear juncture of the two suspenders, protruding outward from the overalls. Additional D-rings may be attached at waist level.

If the clothing is coveralls, the harness is similar to that used with the overalls, modified to accommodate the zipper in front of typical coveralls. A shoulder strap extends vertically downward across the front of the torso, and diagonally downward across the back. The strap extending from the front of the left shoulder wraps around the left leg, and connects to the strap extending from the rear of the right shoulder. Likewise, the strap extending from the front of the right shoulder wraps around the right leg, and connects to the strap extending from the rear of the left shoulder. A D-ring attachment extends upward from the juncture of the two rear shoulder straps, protruding from the collar. Additional D-rings may be attached at waist level.

If the combination clothing/safety harness is used in the course of employment of the wearer, it must meet the requirements of the Occupational Safety and Health Administration. Specifically, the attachment point for a safety line must be in the center of the wearer's back, near shoulder level. D-rings must have a minimum tensile strength of 5,000 lb., and be proof tested to a minimum of 3,600 lb. Buckles must be drop-forged, made of pressed or formed steel, or made of equivalent materials. The harness must be made of synthetic fibers. The overall system must limit the maximum arresting force on the wearer to 1,800 lb., 29 C.F.R. § 1926(d). If the combination clothing/safety harness is used for hunting or other recreational activities, OSHA regulations do not apply, but the harness must still be capable of safely arresting a fall of the wearer.

The combination clothing/harness has important advantages for meeting the above requirements, and for ensuring compliance. By using a garment that the employee would likely wear anyway, the harness will always be present, increasing the likelihood that it will be attached to a safety line when required. The garment will be sized to fit the wearer, thereby increasing the comfort of the harness therein. The harness may be made adjustable in length by conventional means, further increasing comfort. Donning the garment automatically positions the harness in the proper position for use, thereby eliminating the necessity of struggling with a complex arrangement of straps. Attaching the harness to the inside of the garment protects it from adverse weather conditions, prolonging its useful life. Labels on the garment may identify the garment as one containing a harness, and may additionally specify the last inspection date, thereby simplifying enforcement of safety requirements by the employer and by OSHA inspectors. If the wearer does fall, or must be rescued from a confined space, the attachment of the harness to the clothing allows the clothing to increase the surface area bearing against the user, so that the same force results in decreased pressure created by the harness.

The present invention further provides a multiple pieced clothing article, i.e., an outer separate covering and a garment and harness combination that provides complete protection from falls, as well as, offers adaptability to varying climate conditions The combination garment and safety harness of the present invention generally includes a pair of coveralls that have a safety harness sewn directly into the garment so that the wearer in automatically secured into the harness by the simple task of donning the garment. In addition, the combination garment and. safety harness of the present invention does require any additional D-ring, or the like, for providing a lanyard attachment.

The safety harness basically comprises two harness straps that are overlapped at the back of the garment. In this manner, the overlapped harness straps may be stitched, or covered by a wear resistant material, into a double fold. The double fold is exposed through an aperture in the back of the garment so as to be easily and effectively coupled with any lanyard type restraining device. The double fold is formed at the midpoint of each strap. This produces equal distribution of the forces throughout the harness. The straps, namely and upper and lower straps, differ in length, such that the upper strap extends from the double fold, at the lanyard connecting point located centrally on the back of a wearer between his shoulders, up and over each shoulder. The ends of the upper strap terminate in a buckling connector. The lower strap extends, like the upper, from the double fold, down the back, around each leg via the crotch, upwards towards the chest. At the middle of the chest, the lower strap is doubled over on itself, with each end terminating in a mating buckling connector.

The double fold in the front of the harness forms a forward lanyard connection point. In addition, the portion of the lower strap that surrounds the legs may be double folded also, so as to form an auxiliary lanyard connection point or position limiting line connection point. The harness being securely attached to the garment has increased ability in arresting falls because the garment protects the harness from environmental or climatic effects. Alternatively, the auxiliary harness connections may be formed by looping an additional short strap around the upper or lower strap at predetermined intervals, securing the short strap upon itself and terminating the free end with a buckling connector.

The multiple piece clothing article, along with the garment and safety harness combination, also includes the outer covering of a jacket or coat type. The outer covering has apertures strategically placed so as to allow the lanyard connection points of the harness that extend through the combination garment and harness to also extend therethrough. This provides users of the present invention an additional clothing layer during periods of climate changes. For example, a hunter may be waiting for game while perched in a tree stand during early morning hours (i.e., pre-dawn), during which time the temperature is very cool. As the day progresses, (i.e., post-dawn) and the temperatures rises, the hunter can simply remove the outer covering and remain perched safely contained in the harness.

Accordingly, it is a principal object of the invention to provide a combination clothing/safety harness allowing for correct positioning of the harness by donning the clothing.

It is another object of the invention to provide a combination clothing/safety harness providing for wearer comfort.

It is a further object of the invention to provide a combination clothing/safety harness meeting OSHA requirements.

Still another object of the invention is to provide a combination clothing/safety harness allowing for ease of enforcement of safety regulations.

An additional object of the invention is to provide a combination clothing/safety harness which will reduce the pressure applied to the wearer during a fall through the attachment of the harness to the clothing, increasing the surface area against which the force of arresting the fall is distributed.

It is yet another object of the invention to provide a multiple piece clothing article combined with a safety harness.

It is still another object of the invention to provide a multiple piece clothing article combined with a safety harness having a coat or jacket type outer covering which includes apertures for exposing lanyard connectors.

In addition, it is still another object of the invention to provide a safety harness sewn into a garment, the harness including a plurality of double folds stitched together to form a lanyard attachment point.

Still yet another object of the invention is to provide an auxiliary lanyard connector by looping a short strap around the harness straps at predetermined intervals.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

DETAILED DESCRIPTION OF THE PREFERRED EMBODIMENTS

Figure 1:
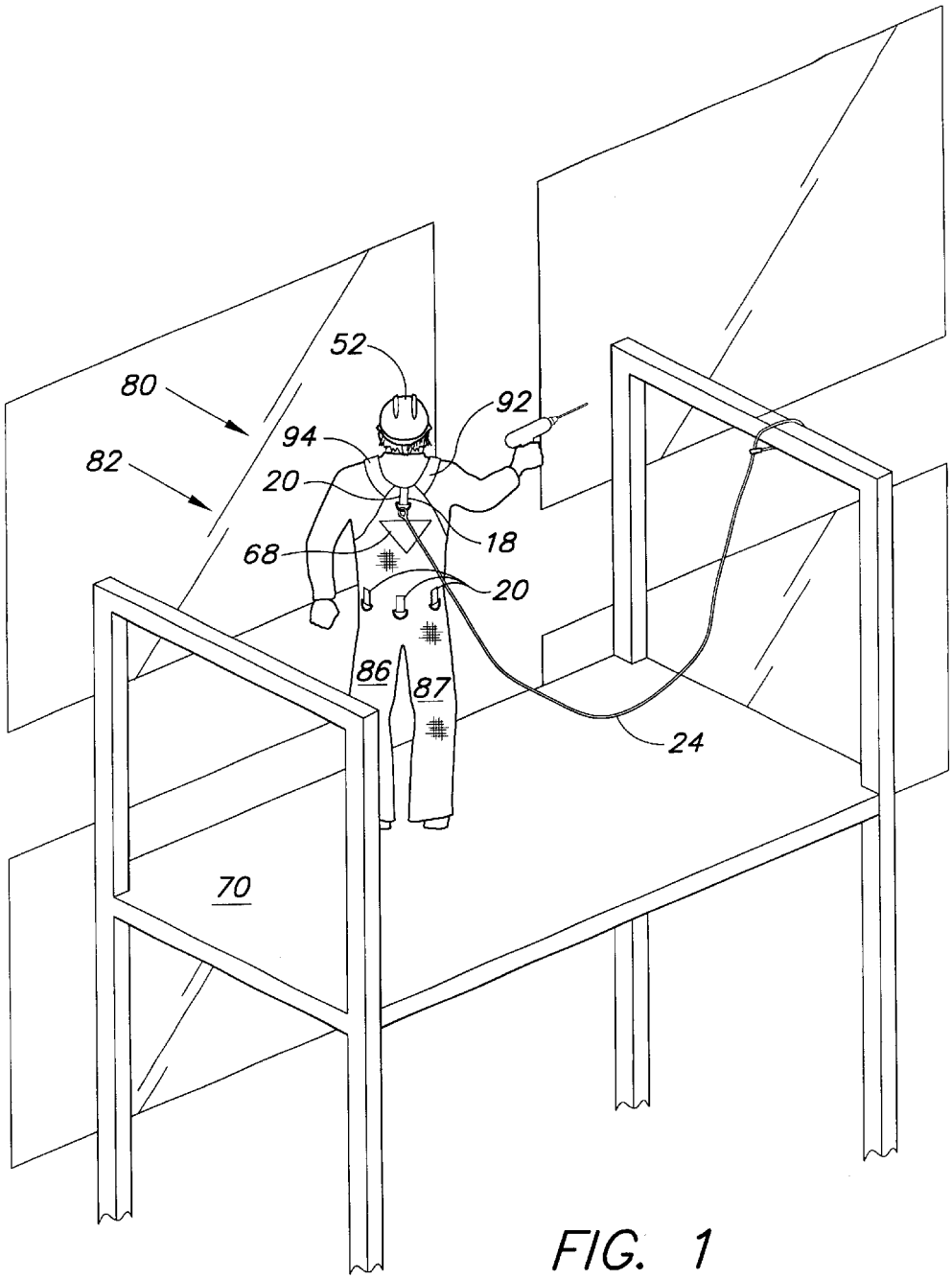
FIG. 1 is an environmental, perspective view of a combination overalls/safety harness according to the present invention.
Figure 2:
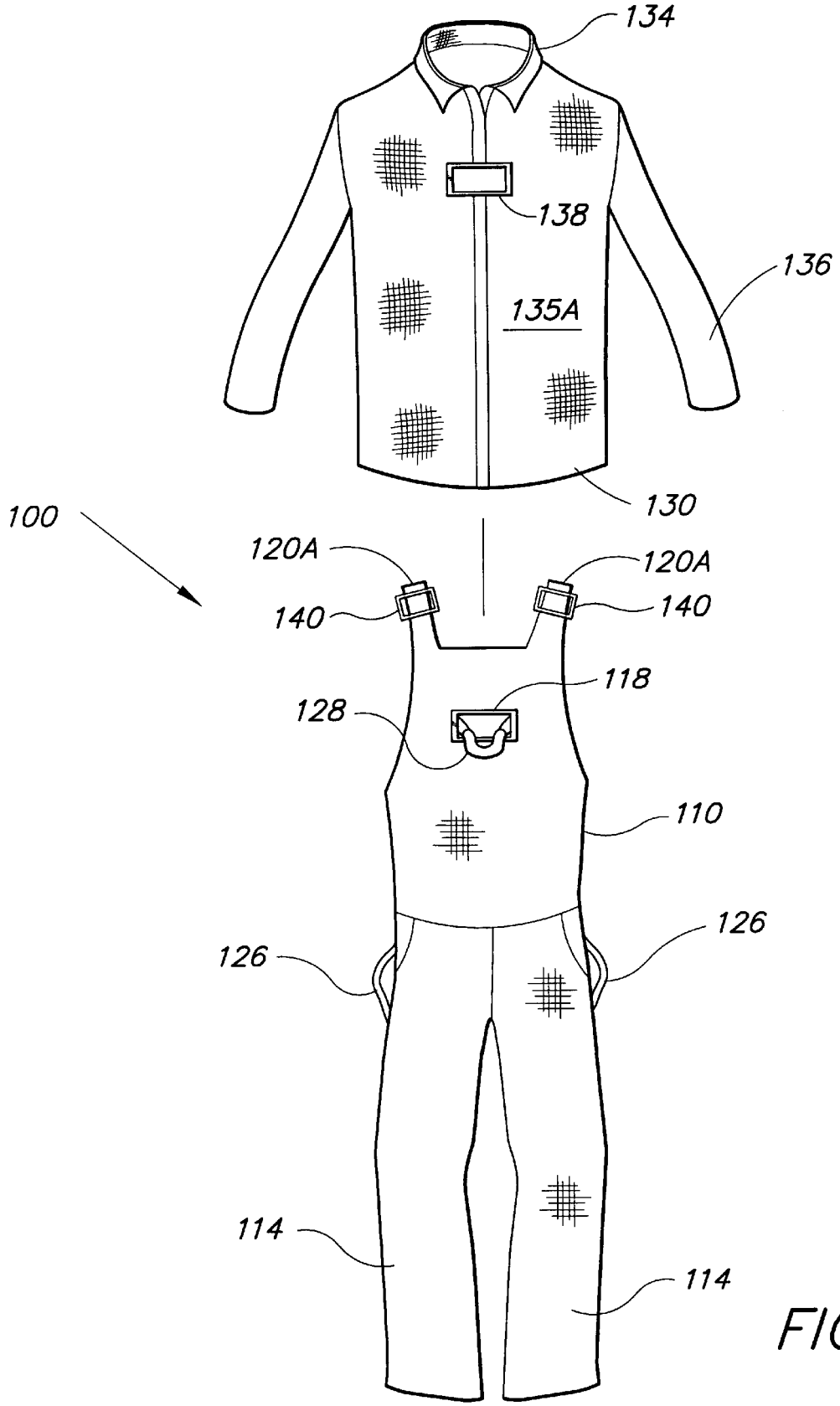
FIG. 2 is an exploded front view of the multiple piece clothing article of the present invention.
Figure 3:
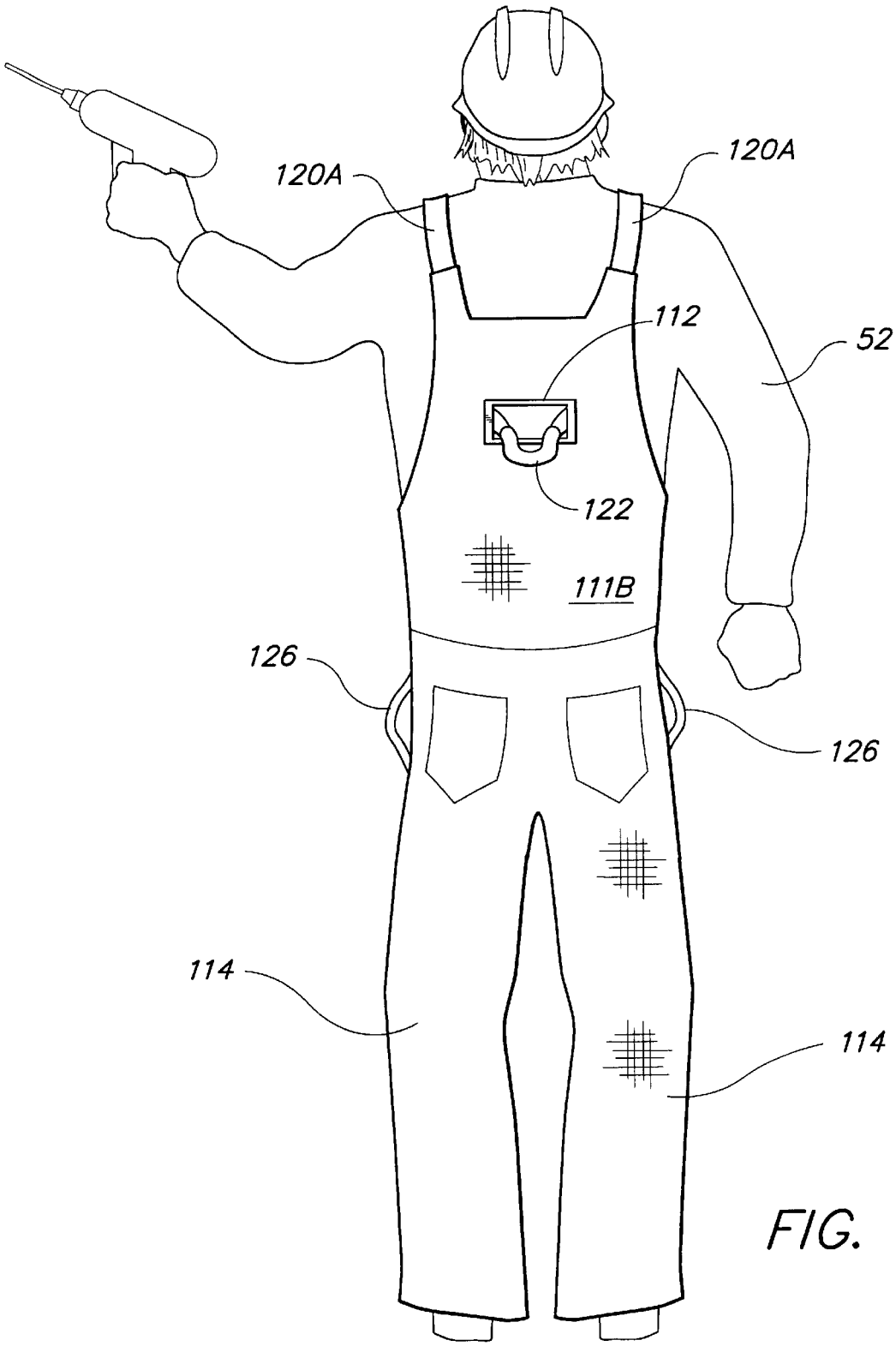
FIG. 3 is an environmental elevational rear view of a person wearing the combination garment and safety harness of the present invention.

A combination garment and safety harness includes a full body garment, such as overalls or coveralls. Referring to FIG. 1, a combination overalls and safety harness 80 is shown. The combination overalls and safety harness 80 includes overalls 82 and safety harness 84. Overalls 82 include a pair of legs 86,87, and a back panel 90.

D-ring attachment strap 18 extends upward from the crossing of straps 92,94 on rear panel 90, positioning D-ring 20 outside of overalls 82, centrally on the back of wearer 52, between his shoulders Additional D-rings 20 may attach to overalls 82 at waist level, for use with safety lines 24 or with position limiting lines.

The overalls 82 preferably include label 68, having indicia designating the overalls 82 as containing a safety harness The label 68 may optionally include information regarding OSHA approval or the last inspection date. The label 68 thereby allows employers or OSHA inspectors to verify that proper safety equipment is being used. Connecting safety line 24 to D-ring 20 allows wearer 52 to safely work on scaffold 70.

Referring now to FIGS. 2–5, a multiple piece clothing garment 100 is illustrated. The clothing article 100 has an outer covering 130 and a combined garment and safety harness 110. The outer covering 130 is coat, jacket, vest or the like, generally worn during periods of inclement weather. The combined garment and safety harness 110 is formed of a pair of coveralls or overalls, as seen in FIG. 1, and a safety harness 120. The overalls include a front bib portion 111A, a back portion 111B, and a pair of pant legs 114. In addition, other optional accents are pockets, labels, etc. The back portion 111B includes an aperture 112, the front portion 111A includes an aperture 118, and each pant leg 114 includes an aperture 116. The apertures 112,116,118 serve basically the same function, as described with respect to the safety harness 120.

Figure 4:
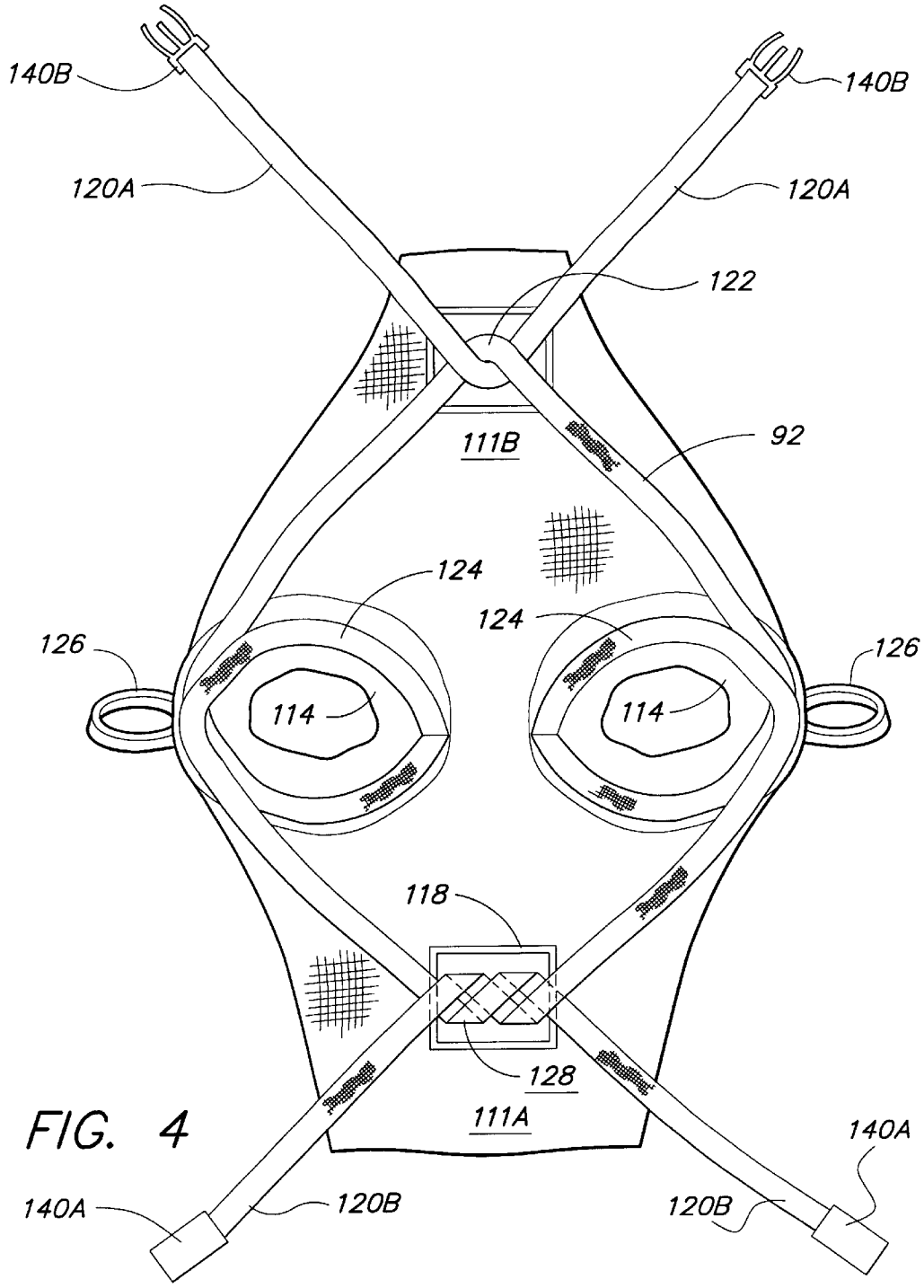
FIG. 4 is a top view of the inside of a combination overalls/safety harness according to the present invention.
Figure 5:
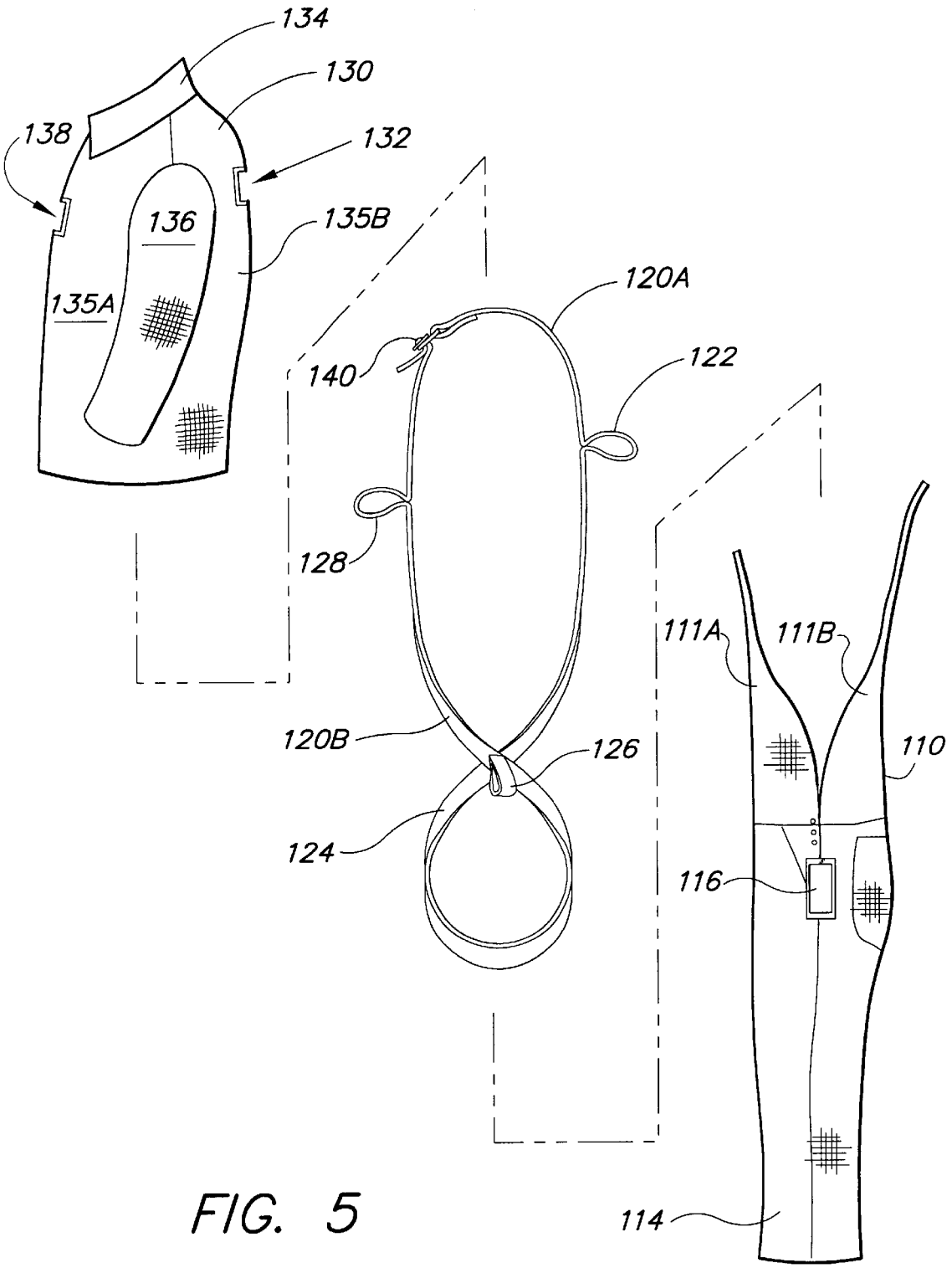
FIG. 5 is an exploded side view of the multiple piece clothing article of the present invention.
Figure 8:
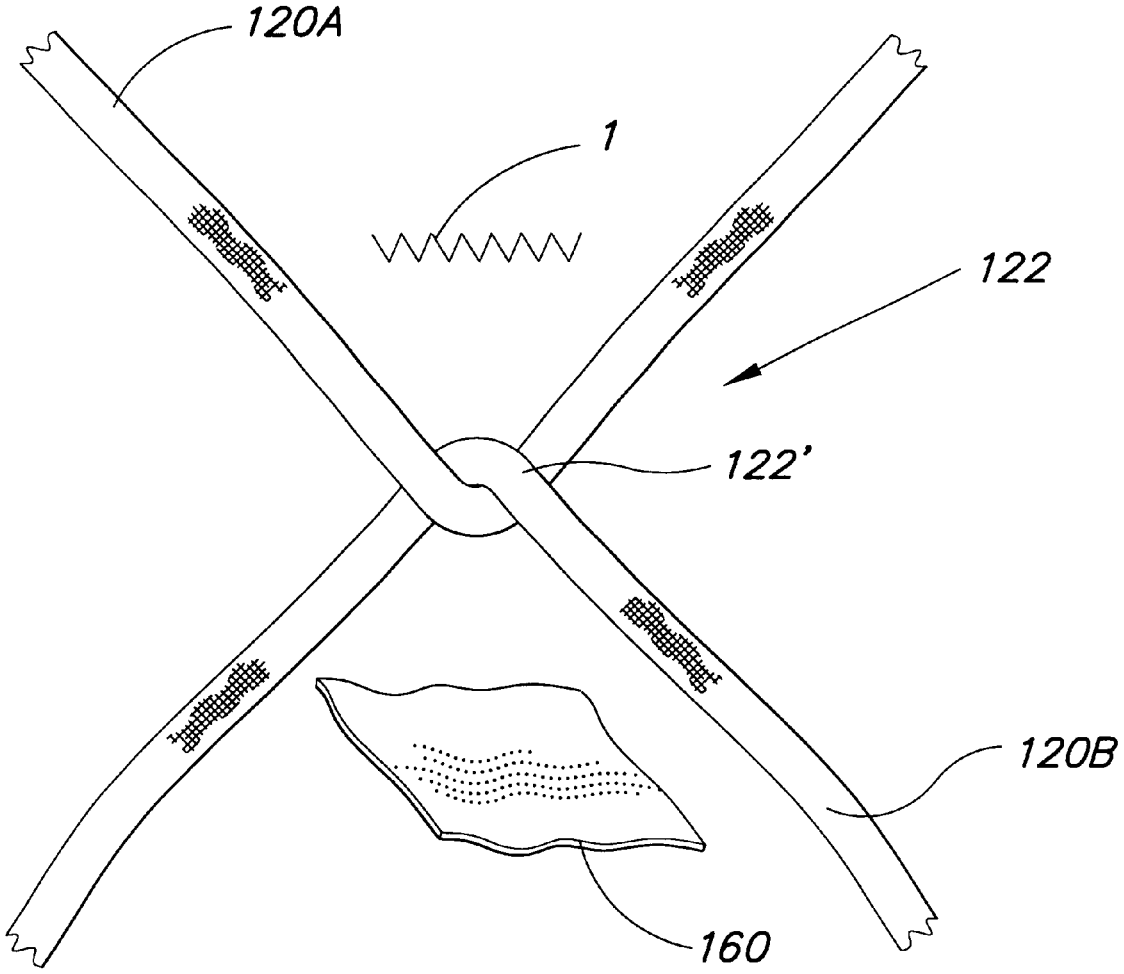
FIG. 8 is an exploded elevational view of the double fold and covering according to the present invention.

The safety harness 120 is composed of an upper harness strap 120A and a lower harness strap 120B. The harness upper strap 120A is relatively shorter in length that the harness lower strap 120B. The harness straps 120A, 120B are overlapped at the back 111B of the overalls and at their respective midpoints. Referring to FIGS. 4 and 8, the overlapped harness straps 122' (see FIG. 8) are preferably covered by a wear resistant material 160. This forms a simple double fold. The upper strap 120A extends from the double fold located centrally on the back of wearer 52, see FIG. 3 between his shoulders, up and over each shoulder.

Each of the ends of the upper strap 120A terminate in a buckling connector 140B. The lower strap 120B extends from the double fold, down the back portion 11B, looped 124 around each pant leg 114 via the crotch of the wearer and then upwards towards the front portion 11A. At the middle of the front portion 11A, the lower strap 120B is doubled over on itself, forming another double fold. The double fold is also covered with a wear resistant material 160. Finally, each end of the lower strap 120B terminates in a mating buckling connector 140A.

Figure 6:
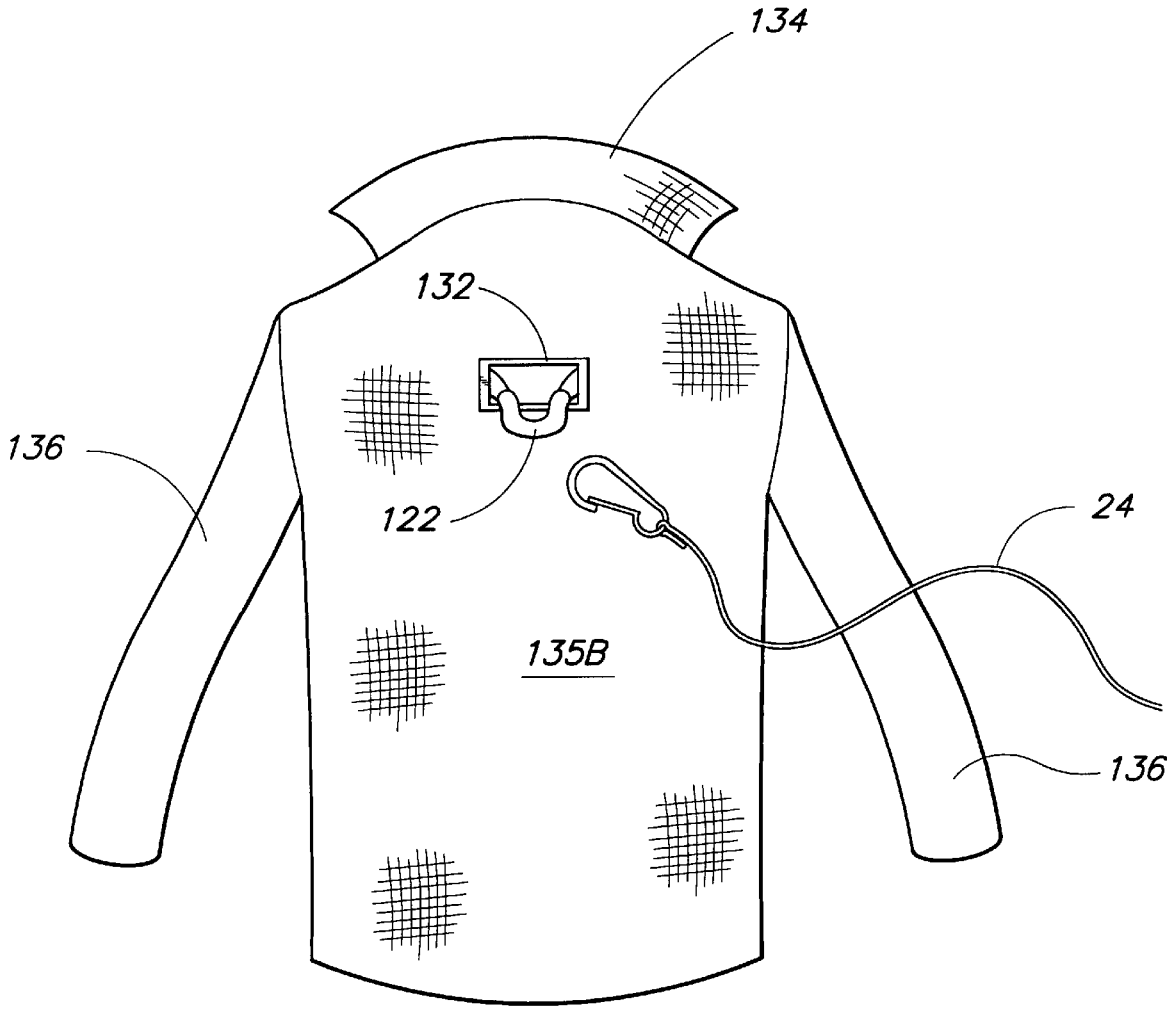
FIG. 6 is an elevational rear view of the outer garment and lanyard connection of the combination garment and safety harness of the present invention.

The double fold is exposed through the aperture 112 in the back 111B of the overalls. The double fold of the harness straps 120A,120B with the wear resistant cover 160 becomes a lanyard connector 122. In this manner, the lanyard connector 122 is easily and effectively coupled with any lanyard type restraining device 24 (note FIGS. 1 and 6). Because the double fold is formed at the midpoint of each harness strap 120A,120B, the applied forces to the lanyard connector 122 due to a fall are equally distributed throughout the harness.

The double fold in the lower strap 120B of the harness forms a forward lanyard connection point 128. In addition, the looped portion 124 of the lower strap that surrounds the legs may also be double folded, so as to form an auxiliary lanyard connection point or position limiting line connection point 126. Each of the lanyard connectors 122,126,128 extend through the respective apertures 112,116,118. The safety harness 120 is securely attached to the interior of the overalls by stitching. Although, any other suitable method of permanent affixing the harness 120 to the overalls is within the scope of this disclosure. Such alternative forms may include, but are not limited to, fabric welding, adhesive joining, weaving, etc.

Figure 7:
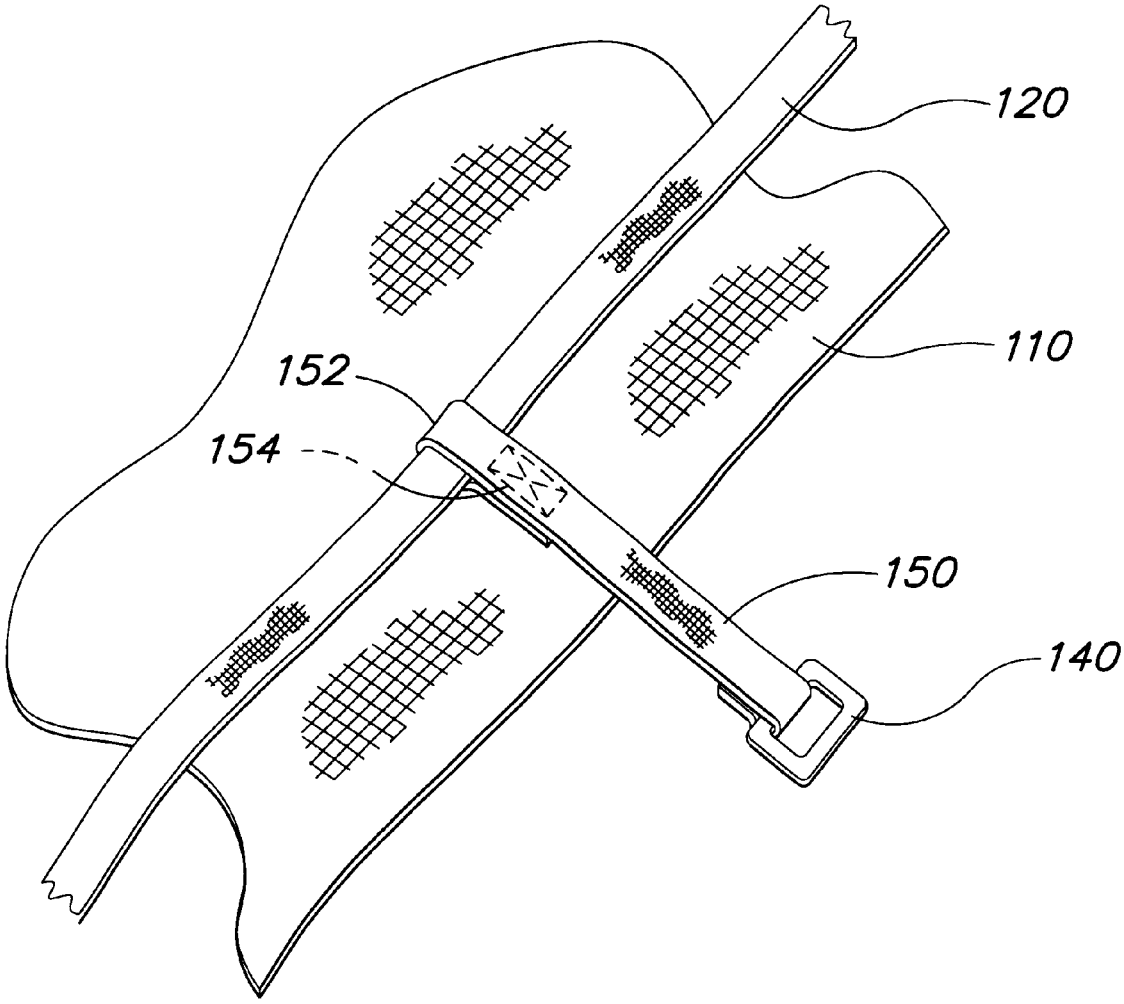
FIG. 7 is an fragmentary perspective view of an auxiliary lanyard connector according to the present invention.

Referring to FIG. 7, an additional lanyard connector or buckling connector 140 is incorporated into the safety harness and garment combination. The additional connector 140 is formed by providing a short length of harness strap material 150 having a buckling or lanyard connector 140 at one end. The other end of the short strap 150 is looped around a segment of safety harness 120 at portion 152. The end of the short strap 150 looped portion 152 is fixedly attached to the an intermediary portion 154 of short strap 150. The attachment is preferably stitching, however any other suitable form of attachment is within the scope of this disclosure. Such alternative forms may include, but are not limited to, fabric welding, adhesive joining, weaving, etc. The purpose of the looped portion provides greater strength because the harness is not weakened by directly stitching the short strap 150 to the harness straps 120.

FIG. 8 illustrates a preferred method of making the lanyard connector 122. The upper strap 120A and lower strap 120B are folded over each other at 122'. Around the fold 122', a wear resistant material 160 is placed, and the wear resistant material in fixedly secure thereto by a permanent attachment member 1, shown as stitching, however, any suitable form of attachment is within the scope of this disclosure. Such alternative forms may include, but are not limited to, fabric welding, adhesive joining, weaving, etc. Likewise, the wear resistant material may be in the form of a tubular body that has the folded over portion 122' encased therein. The wear resistant material may be chosen from leather, vinyl, metals, etc. and may possess the properties of being either flexible, semi-rigid, rigid, resilient, malleable, etc.

The multiple piece clothing article also includes the outer covering 130 of a jacket or coat type. The outer covering 130 has apertures 132,138 strategically placed so as to allow the lanyard connectors 112,118 of the harness that extend through the overalls, to further extend through the outer covering 130. This provides users with an additional clothing layer during periods of climate changes. Typically, the outer covering 130, is in the form of a jacket or coat, having a back panel 135B, a pair of sleeves 136 and a collar 134. If the outer covering 130 is a pull over type jacket, or the like, a single front panel 135A is provided, whereas, if the outer covering 130 is an open front (i.e., buttoned down or zippered) type jacket or coat, a mirrored pair of front panels 135A is provided. Further, it is understood that in a coat type outer covering 130, if the sides of the coat extends below the hips of the wearer, then additional apertures must be provided in order to access the lanyard connectors 126 along side each leg, or where ever a lanyard connector may be present.

It is to be understood that the present invention is not limited to the embodiments described above, but encompasses any and all embodiments within the scope of the following claims.

We claim:

1. A combination garment and safety harness comprising:

a garment including an interior and an exterior, said garment having a front portion defining an aperture, a back portion defining an aperture, and a pair of legs, each of said legs defining an aperture at the side thereof;

a harness for encircling body portions of a wearer for maintaining the wearer in a substantially vertical disposition;

said harness including a first strap and a second strap, said first strap having two ends and a midpoint, said second strap having two ends and a midpoint, said second strap being substantially greater in length than said first strap, and said first strap and said second strap being folded about each other at their respective midpoints;

said first strap extending from the folded midpoints up and over each shoulder of the wearer, the ends of said first strap having means for buckling;

said second strap extending from the folded midpoints, down the back of the wearer, encircling each leg, via the crotch of the wearer, and upwardly towards the chest or the wearer, said second strap being folded at the chest of the wearer and further extending upwardly towards the shoulders of the wearer, the ends of said second strap having means for matingly buckling with said means for buckling of said first strap;

said first and second straps of said harness being fixedly attached to the interior of said garment; and outer covering means for donning over said garment and harness, said outer covering means including a back panel, at least one front panel, and a collar;

said back panel defining an aperture therein;

said at least on front panel defining an aperture therein;

wherein said folded midpoints of said first and second straps extend through said aperture of said back portion of said garment and through said aperture of said back panel of said outer covering, and wherein said folded second strap extends through said aperture of said front portion of said garment and through said aperture of said front panel of said outer covering;

whereby said folded midpoints and said folded second strap providing a connection for a lanyard.

2. The combination garment and safety harness according to claim 1, further comprising means for encasing said folded midpoints of said first and second straps, and for encasing said folded second strap; said means for encasing being formed of wear resistant material.

3. The combination garment and safety harness according to claim 1, said second strap further being folded adjacent said encircling each leg, wherein said folded second strap adjacent each leg extends through the aperture at the side of said legs of said garment, said folded second strap forming an auxiliary lanyard connector.

4. The combination garment and safety harness according to claim 3, further comprising means for encasing said folded midpoints of said first and second straps, and for encasing said folded second strap; said means for encasing being formed of wear resistant material.

5. A combination garment and safety harness comprising:

a garment including an interior and an exterior, said garment having a front portion defining an aperture, a back portion defining an aperture, and a pair of legs, each of said legs defining an aperture at the side thereof;

a harness for encircling body portions of a wearer for maintaining the wearer in a substantially vertical disposition;

said harness including a first strap and a second strap, said first strap having two ends and a midpoint, said second strap having two ends and a midpoint, said second strap being substantially greater in length than said first strap, and said first strap and said second strap being folded about each other at their respective midpoints;

said first strap extending from the folded midpoints up and over each shoulder of the wearer, the ends of said first strap having means for buckling;

said second strap extending from the folded midpoints, down the back of the wearer, encircling each leg, via the crotch of the wearer, and upwardly towards the chest or the wearer, said second strap being folded at the chest of the wearer and further extending upwardly towards the shoulders of the wearer, the ends of said second strap having means for matingly buckling with said means for buckling of said first strap; and said first and second straps of said harness being fixedly attached to the interior of said garment.

6. The combination garment and safety harness according to claim 5, said garment further comprising an outer covering including a back panel, at least one front panel, and a collar;

said back panel defining an aperture therein;

said at least on front panel defining an aperture therein;

wherein said folded midpoints of said first and second straps extend through said aperture of said back portion and through said aperture of said back panel of said outer covering, and wherein said folded second strap extends through said aperture of said front portion and through said aperture of said front panel of said outer covering;

whereby said folded midpoints and said folded second strap providing a connection for a lanyard.

7. The combination garment and safety harness according to claim 6, further comprising means for encasing said folded midpoints of said first and second straps, and for encasing said folded second strap; said means for encasing being formed of wear resistant material.

8. The combination garment and safety harness according to claim 6, said second strap further being folded adjacent said encircling each leg, wherein said folded second strap adjacent each leg extends through the aperture at the side of said legs of said garment, said folded second strap forming an auxiliary lanyard connector.

9. The combination garment and safety harness according to claim 8, further comprising means for encasing said folded midpoints of said first and second straps, and for encasing said folded second strap; said means for encasing being formed of wear resistant material.

10. The combination garment and safety harness according to claim 6, further comprising at least one auxiliary lanyard connector, each said at least one lanyard connector including a substantially short length of strap having a first end and a second end, said first end having a means for coupling disposed thereon, and said second end having a loop for encircling one of said straps of said harness, whereby said fixedly attached harness to said garment preventing said loop of each of said at least one auxiliary lanyard connector displacing along said strap.

* * * * *